US006922874B2

(12) United States Patent
Gabathuler

(10) Patent No.: US 6,922,874 B2
(45) Date of Patent: Aug. 2, 2005

(54) HOUSING COVER FOR ELECTRONIC MICRODEVICES

(75) Inventor: Bruno Gabathuler, Stäfa (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 10/403,493

(22) Filed: Mar. 31, 2003

(65) Prior Publication Data

US 2004/0187262 A1 Sep. 30, 2004

(51) Int. Cl.[7] ..... E05D 3/06

(52) U.S. Cl. ..... 16/366; 16/368; 16/242; 381/328

(58) Field of Search ..... 16/366, 368, 369; 381/322, 323, 328; 49/193, 402, 383, 388, 398, 399; 220/817, 818, 819, 822

(56) References Cited

U.S. PATENT DOCUMENTS

| | | | | | |
|---|---|---|---|---|---|
| 117,016 | A | * | 7/1871 | Terwilliger | 16/366 |
| 428,402 | A | * | 5/1890 | Morris | 16/366 |
| 2,564,988 | A | * | 8/1951 | Muller | 49/253 |
| 3,195,945 | A | * | 7/1965 | Barenyi | 49/253 |
| 4,386,847 | A | * | 6/1983 | Torto et al. | 355/75 |
| 4,388,779 | A | * | 6/1983 | Peterson | 49/253 |
| 4,843,680 | A | * | 7/1989 | Cress et al. | 16/289 |
| 4,917,446 | A | * | 4/1990 | Mariani | 312/325 |
| 5,213,286 | A | * | 5/1993 | Elliott et al. | 244/129.4 |
| 5,494,447 | A | * | 2/1996 | Zaidan | 439/31 |
| 5,505,635 | A | * | 4/1996 | Willows et al. | 439/500 |
| 5,541,712 | A | * | 7/1996 | Fujitaka et al. | 399/380 |
| 5,588,064 | A | * | 12/1996 | McSwiggen et al. | 381/312 |
| 5,687,242 | A | * | 11/1997 | Iburg | 381/312 |
| 5,784,470 | A | * | 7/1998 | Fackler et al. | 381/328 |
| 5,889,874 | A | * | 3/1999 | Schmitt et al. | 381/328 |
| 6,144,749 | A | | 11/2000 | Fideler | |
| 6,154,359 | A | * | 11/2000 | Kamikakai et al. | 361/681 |
| 6,185,096 | B1 | * | 2/2001 | Helot et al. | 361/686 |
| 6,499,189 | B2 | * | 12/2002 | Kondo et al. | 16/289 |

FOREIGN PATENT DOCUMENTS

| | | | | |
|---|---|---|---|---|
| DE | 34 06 972 | A | 8/1985 | |
| DE | 19601231 | A1 * | 7/1997 | H04R/25/00 |
| EP | 684749 | A2 * | 11/1995 | H04R/25/02 |
| JP | 2003278440 | A * | 10/2003 | E05F/11/20 |
| WO | 99 48330 | A | 9/1999 | |

* cited by examiner

*Primary Examiner*—Chuck Y. Mah
(74) *Attorney, Agent, or Firm*—Pearne & Gordon LLP

(57) ABSTRACT

A system for covering and closing off a housing of an electronic microdevice with a cover plate that extends over a mostly level surface of a faceplate of the housing. Rotary or pivoting hinges are provided to allow the cover plate to be lifted off of the surface of the faceplate while maintaining the cover plate essentially parallel to the faceplate. The system may be used for closing off a hearing-aid housing, an FM receiver housing or other housing.

19 Claims, 2 Drawing Sheets

HOUSING COVER FOR ELECTRONIC MICRODEVICES

FIELD OF THE INVENTION

This invention relates to a device for covering and sealing the housing of an electronic microdevice, and a cover for closing of the housing of a hearing aid and specifically for sealing the housing of a so-called in-ear hearing aid.

BACKGROUND OF THE INVENTION

The lids or covers of electronic microdevices such as hearing aids are usually attached at one end to a hinge around whose pin they can pivot, allowing them to be opened and closed so as to cover an opening in the housing of the electronic microdevice.

There is a risk especially in the case of new-generation in-ear hearing aids to the effect that the cover plate of the housing or of the battery compartment may not close tightly. The hinge section is particularly difficult to seal tightly, and the acoustic seal as well cannot be optimized.

A contributor to the problem is the fact that the technology employed in producing housings for in-ear hearing aids does not offer the precision needed to assure a seal that is 100% tight.

BRIEF SUMMARY OF THE INVENTION

It is therefore the objective of this invention to introduce a housing cover for electronic microdevices such as hearing aids by means of which the housing can be sealed off tightly against the outside, preventing for instance moisture or perspiration from penetrating into the housing. This is a particularly important requirement for electronic microdevices since exposure to any moisture, especially to perspiration in the case of hearing aids, can severely damage or even destroy the electronics.

This invention provides for the opening in the housing of the electronic microdevice to be sealed by a cover plate that is opened and closed via at least two rotaty or pivoting hinges, permitting the cover to be lifted off in largely parallel fashion.

This design makes it possible for the minimum of two rotary or pivoting hinges to be located inside the cover, i.e. inside the opening, meaning that the two hinges are not visible from the outside and they do not have to be sealed, which eliminates the hinge-sealing problem. One hinge is preferably recessed on or in the cover, the other hinge inside the opening, and the two hinges are linked to each other for instance via a connecting strap. The two pivots are positioned in the cover and in the opening at opposite ends relative to the cover.

The connector between the two hinges may be linear and rigid, or curved and especially circular or bow-shaped, in which latter case the connecting strap may even be slightly flexible. A circular configuration of this connecting link is particularly useful if it also serves to accommodate a battery for powering the electronic microdevice. Mounting the battery in that fashion also offers an advantage whereby, as the cover is opened, the battery compartment is swiveled out of the unit, facilitating for instance battery replacement. It would even be possible for the compartment to accommodate not only the battery but also other components of the hearing aid, which components as well could be swiveled out for convenient servicing.

It is further suggested that a flexible seal be provided around the perimeter preferably in a frame in or on the opening. That flexible seal, on which the cover sits tightly when closed, may be produced for instance by an injection process whereby a 2-component material is molded onto the housing concurrently with the fabrication of the housing.

The system proposed and described for covering the housing of an electronic microdevice is particularly suitable for sealing the housing of a hearing aid, especially for covering and closing off a so-called in-ear housing, such so-called in-ear housings being most susceptible to the problems mentioned above. Using a cover of the design described offers the following advantages:

- The ability of the cover plate to open up on a plane parallel to the housing allows for any shape of the cover and the opening, which is particularly desirable for the so-called faceplates of the aforementioned in-ear housings.
- There are no visible hinges on the outside of the housing.
- The cover plate prevents perspiration from penetrating into the interior of the hearing-aid housing. The seal around the perimeter i.e. all around the edges closes the opening off in continuous, tight fashion.
- There is even an acoustic seal between the inside and outside of the device.
- A cover designed with a simple outer contour lends itself particularly well to the fabrication of the aforementioned in-ear housings by novel production techniques including, for example, so-called powder metallurgy involving a sintering process. While this particular production technique does not offer the precision normally required for electronic microdevices, the design of the cover system described is such as to make up for that shortcoming.

The following description of an implementation example will explain this invention in more detail with reference to the attached drawings in which

DETAILED DESCRIPTION OF THE INVENTION

Figure 1:
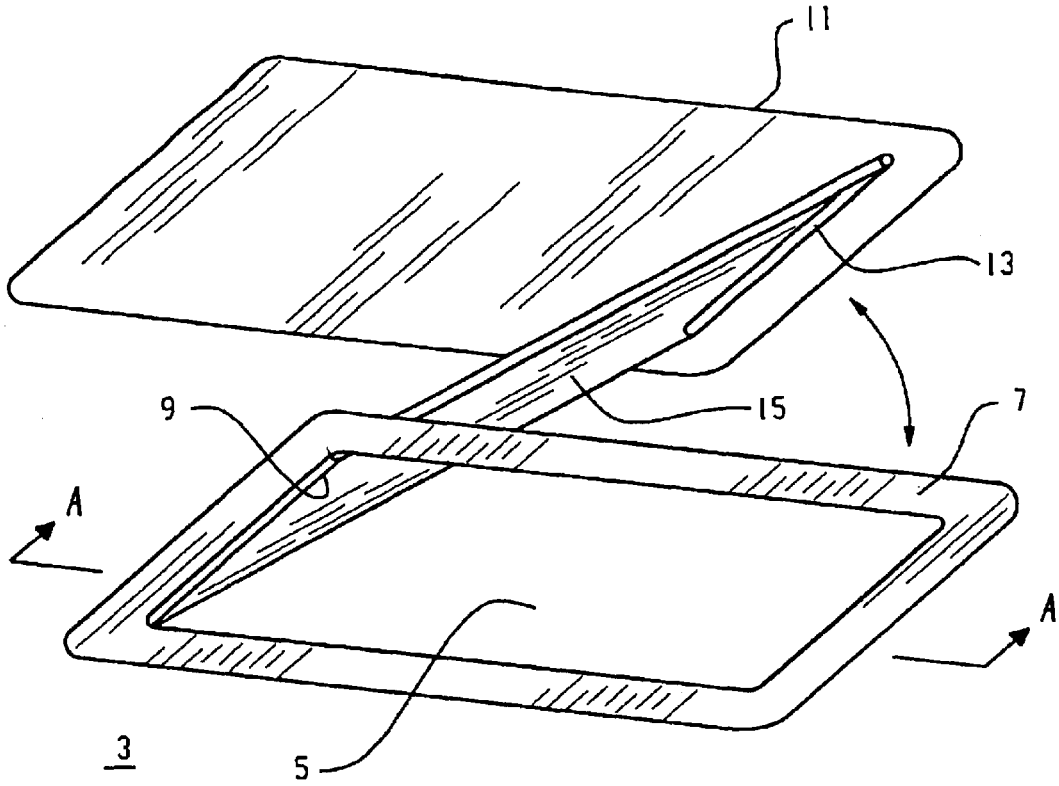
FIG. 1 is a schematic, perspective illustration of one possible configuration of a cover plate system per this invention for closing off the opening of a housing.

FIG. 1 is a schematic, perspective illustration of an opening in the faceplate of a hearing aid, together with a matching cover plate that serves to close off the opening. Within the faceplate 3 the opening 5 is rimmed by a frame 7 that may protrude either inward into the faceplate or outward from it. Mounted inside the edge at one end is a hinge or pivot 9 by means of which the cover 11 can be lifted to permit access to the opening 5. An at least nearly parallel retraction of the cover 11 is made possible by providing another pivot or hinge 13 on the underside of the cover 11, which hinge 13 is linked to the hinge 9 in the opening 5 via a connecting strap or bracket 15.

Figure 2:
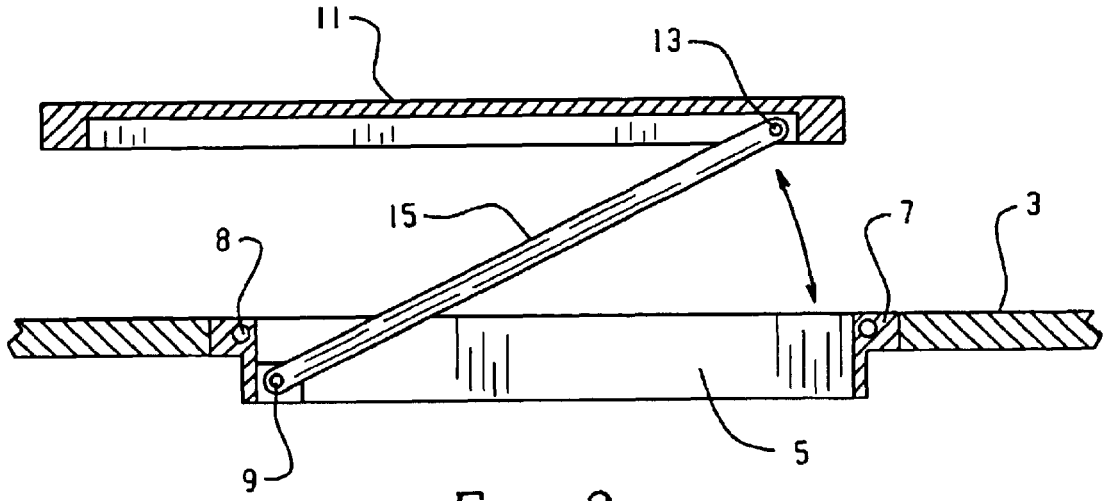
FIG. 2 is a cross-section view of the object of this invention shown in FIG. 1.

FIG. 2 is a schematic cross-section view of the opening of FIG. 1 along the line A—A. As said above, the opening 5 in the faceplate 3 is rimmed by a frame 7. FIG. 2 clearly shows that frame protruding inward into the faceplate 3 while being flush with the outside surface.

The frame 7 is provided with a seal 8 that may be a flexible gasket or an elastomeric polymer seal. This seal 8 may be set into the recess of the frame 7 after the faceplate is produced, or it may be molded in, by the so-called 2-component injection process, at the time the faceplate i.e. the hearing-aid housing is produced.

The two hinges, i.e. 9 in the opening 5 and 13 on the cover 11, are connected, pivotably in the direction of the arrow, via a connecting strap or bracket 15. This dual-hinge configuration makes it possible to open the cover 11 by lifting or "swiveling" it away from the faceplate 3 essentially parallel to the latter. By virtue of the essentially parallel withdrawal there is no tilting and, moreover, the two hinges 9 and 13 can be mounted in "concealed" fashion i.e. recessed into the cover and the opening. It follows that with a cover plate system as illustrated in FIGS. 1 and 2, no hinges are visible on the outside of the device i.e. of the cover.

Figure 3:
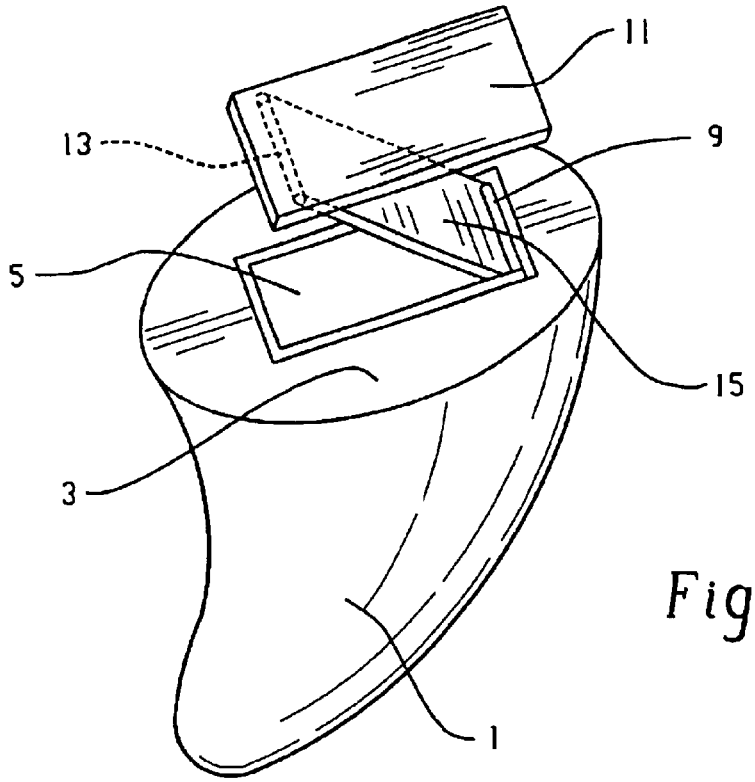
FIG. 3 is a top view of the cover and the so-called faceplate of an in-ear hearing-aid housing.

FIG. 3. is a schematic, perspective top view of the faceplate of an in-ear hearing aid 1, which latter is typically 1 to a maximum of 2 cm in size as viewed in the direction of the auditory canal.

Figure 4:
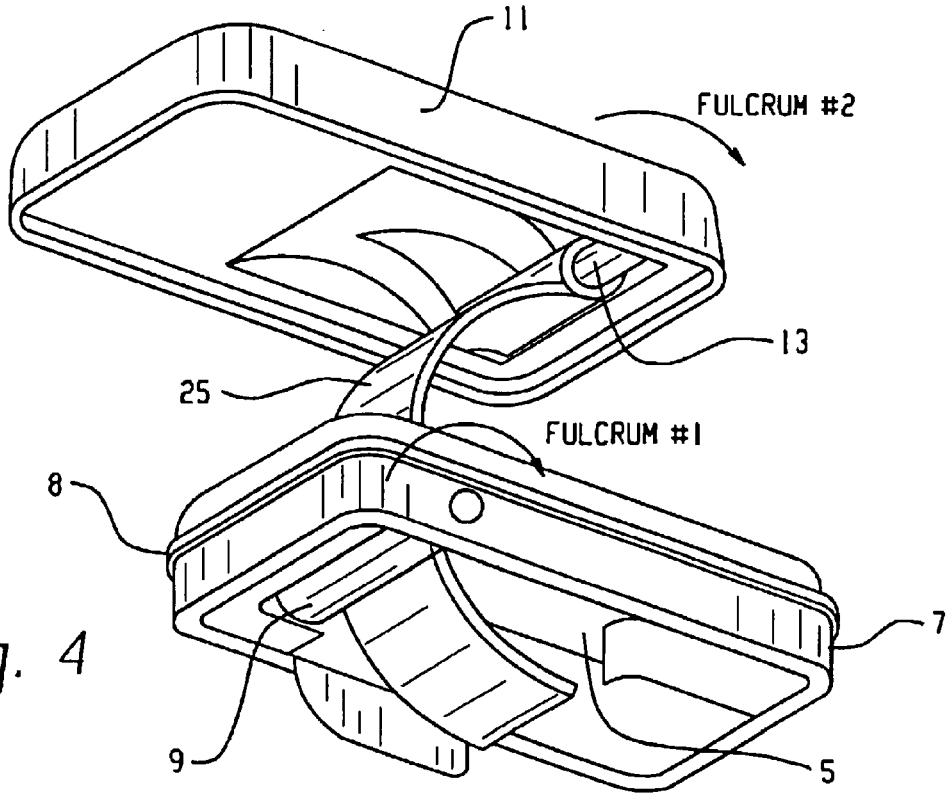
FIG. 4 shows another design variation of a cover according to the invention, suitable for additionally accommodating and retaining a battery that supplies the electronic microdevice with power.

Finally, FIG. 4 illustrates another preferred design version of the cover plate system per this invention for the faceplate of an in-ear hearing aid housing. In this illustration as well, the faceplate, only marginally outlined, bears the reference number 3. The frame or ledge 7, rimming the opening 5, is again provided with a gasket-type seal.

In contrast to the design per FIGS. 1 to 3, the cover system in FIG. 4 features a curved or bow-shaped, largely circular strap 25 that connects the two hinges 9 and 13. Accordingly, this strap 25 is pivotably linked to the faceplate 3 via the hinge 9 and pivotably linked to the cover plate 11 via the hinge 13. The resulting fulcra 1 and 2 again make it possible to lift the cover 11 off the faceplate 3 in largely parallel fashion. Moreover, in the design version per FIG. 4 as well, the two hinges can be mounted out of sight. The benefit offered by the configuration per FIG. 4 lies in the fact that the bow strap 25 can serve as a holder for instance for a battery that provides the power for the hearing aid. When the cover plate 11 is opened the battery, held in place by the strap 25, is simultaneously swiveled out of the hearing aid housing, allowing it to be replaced if it is largely or completely exhausted.

Of course, the design variations illustrated in FIGS. 1 to 4 are examples only, serving to explain this invention in more detail. The invention is in no way limited to the design examples shown and it is entirely possible for instance to design the connecting strap or bracket 15 or 25 between the two hinges in a different way, whether rigid, flexible, linear, curved, with angular corners, etc. Nor are the materials employed specific to this invention. For one, it is certainly possible to use the polymer materials that also lend themselves to the production of the hearing-aid housings and in particular of in-ear hearing aid housings. This would usually include the so-called biocompatible polymers that are dermatocompatible while also offering a certain chemical resistance especially to perspiration. By the same token, the frame 7 can be provided with a gasket or seal in a variety of ways, and the choice of materials for the seal is not an essential part of this invention.

What is claimed is:

1. A cover system for a housing of an electronic microdevice comprising:

a faceplate of a housing;

a cover plate that extends over a largely level surface of the faceplate; and at least two hinges connecting the cover plate to the faceplate so as to permit essentially parallel lifting of the cover plate from a closed position to an oven position spaced from a surface of the faceplate, wherein one of the hinges is mounted to the cover plate and another hinge is mounted to an opening in the faceplate that can be closed by means of said cover plate.

2. The cover system of claim 1, wherein hinges said at least two are connected to each other, whereby, as the opening is opened or closed, a connecting element is swiveled around a pivot axis of the hinge that is positioned the opening.

3. The cover system of claim 2, wherein the connecting element is essentially linear and rigid.

4. The cover system of claim 2, wherein the connecting element is essentially curved in circular fashion and is slightly flexible.

5. The cover system of claim 2, wherein the connecting element is adapted to accommodate a hearing-aid component.

6. The cover system of claim 5, wherein the hearing-aid component is a battery.

7. The cover system of claim 6, wherein, in addition to the battery, the connecting element can accommodate at least one other hearing-aid component.

8. The cover system of claim 1, further comprising a flexible sealing element provided along a perimeter of the opening in the faceplate.

9. The cover system of claim 8, wherein the sealing element is molded into the frame on the opening by a 2-component injection process at the time the housing is produced.

10. Tho cover system of claim 1, wherein the hinges are recessed into the opening in the faceplate and the cover plate in such fashion that they are not openly visible.

11. The cover system of claim 1, further comprising a hearing-aid housing, wherein the cover plate is adapted to close an opening in the hearing-aid housing, wherein the opening in the hearing-aid housing communicates with the opening in the faceplate.

12. The cover system of claim 1, further comprising a hearing-aid housing, wherein the cover plate is adapted to seal an opening in the hearing-aid housing, wherein the opening in the hearing-aid housing communicates with the opening in the faceplate.

13. The cover system of claim 1, further comprising a frequency-modulated (FM) receiver housing, wherein the cover plate is adapted to close an opening of the FM receiver housing, wherein the opening in the FM receiver housing communicates with the opening in the faceplate.

14. The cover system of claim 1, further comprising a frame provided around a rim of the opening in the faceplate and a housing, the frame being adapted to be mounted to the housing, wherein the opening in the faceplate communicates with an opening the housing.

15. The cover system of claim 14, wherein the frame protrudes inward into the faceplate.

16. The cover system of claim 14, wherein the frame protrudes outward from the faceplate.

17. The cover system of claim 14, wherein the frame is provided with at least one of a flexible gasket and an elastomeric polymer seal.

18. A cover system for a housing of an electronic microdevice comprising:

a faceplate of a housing;

a cover plate that extends over a largely level surface of the faceplate; and at least two hinges connecting the cover plate to the faceplate so as to permit essentially parallel lifting of the cover plate from a closed position to an open position spaced from a surface of the faceplate, wherein the two hinges are respectively mounted at opposite ends relative to the cover plate and an opening in the faceplate.

19. A housing of an electronic microdevice comprising:

a housing;

a faceplate having an opening therein;

a frame provided around a periphery of the opening;

a cover plate adapted to close off the opening; and at least two hinges connecting the cover plate to the housing so as to permit essentially parallel lifting of the cover plate from a closed position to an open position spaced from a surface of the faceplate, wherein one hinge is mounted to the cover plate and another hinge is mounted to an opening in the faceplate.

* * * * *

UNITED STATES PATENT AND TRADEMARK OFFICE

CERTIFICATE OF CORRECTION

PATENT NO. : 6,922,874 B2
DATED : August 2, 2005
INVENTOR(S) : Bruno Gabathuler

It is certified that error appears in the above-identified patent and that said Letters Patent is hereby corrected as shown below:

Column 2,
Line 33, insert -- BRIEF DESCRIPTION OF THE SEVERAL VIEWS OF THE DRAWINGS --.
Lines 38-39, delete "BRIEF DESCRIPTION OF THE SEVERAL VIEWS OF THE DRAWINGS".

Column 4,
Line 10, delete "oven", and insert -- open --.
Lines 16-17, delete "hinges said at least two", and insert -- said at least two hinges --.

Signed and Sealed this

Twenty-third Day of May, 2006

JON W. DUDAS
*Director of the United States Patent and Trademark Office*